US006568787B1

(12) United States Patent
Girones et al.

(10) Patent No.: US 6,568,787 B1
(45) Date of Patent: May 27, 2003

(54) APPARATUS AND METHOD FOR ACCURATELY POSITIONING INKJET PRINTHEADS

(75) Inventors: Xavier Girones, Tarragona (ES); Xavier Bruch, Barcelona (ES); Christopher Taylor, Cely-en-Biere (FR); Antoni Murcia, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/506,151

(22) Filed: Feb. 17, 2000

(30) Foreign Application Priority Data

Feb. 17, 1999 (EP) ..... 99301170

(51) Int. Cl.[7] ..... B41J 2/165
(52) U.S. Cl. ..... 347/22
(58) Field of Search ..... 347/22, 23, 19, 347/37, 24

(56) References Cited

U.S. PATENT DOCUMENTS 5,397,192 A * 3/1995 Khormaee ..... 347/37 X
5,404,020 A * 4/1995 Cobbs ..... 347/19 X
5,835,108 A 11/1998 Beauchamp et al. ..... 347/19

FOREIGN PATENT DOCUMENTS

EP 0 540 244 A2 5/1993 ..... B41J/25/304
EP 0 863 009 A1 9/1998 ..... B41J/2/165

* cited by examiner

*Primary Examiner*—Hai Pham

(57) ABSTRACT

To accurately position printheads (C,M,Y,K) of an inkjet printer 100 in the capping area of their service station (130), the position of service station insert members (e.g. 130K) is determined by an optical sensor (117) detecting a through hole (132K) in the cartridge lid (131), and the separation (j) of the optical sensor and the printheads (e.g. K) is precisely determined. The separation (j) is determined by using the printhead nozzles to print lines (144,146) in the directions of the scan and media axes, scanning the lines with the optical sensor (117), and calculating from the results the separation (j). The results of locating the four reference holes (132C, 132M, 132Y, 132K) of the service station insert members may be averaged.

17 Claims, 4 Drawing Sheets

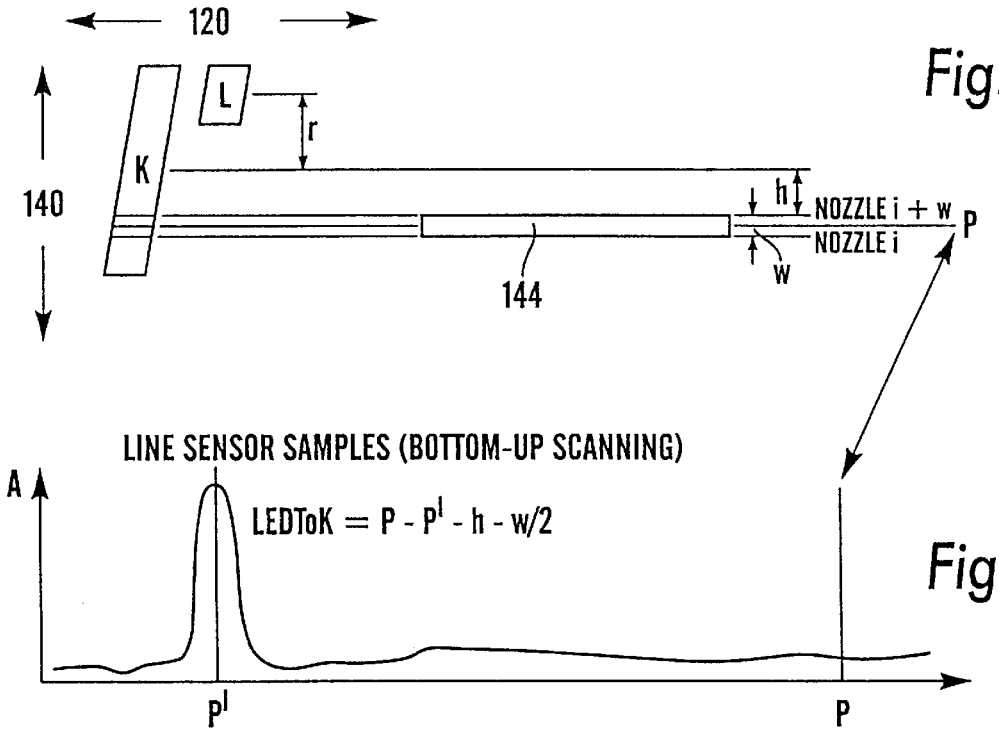
Fig.5a
Fig.5b
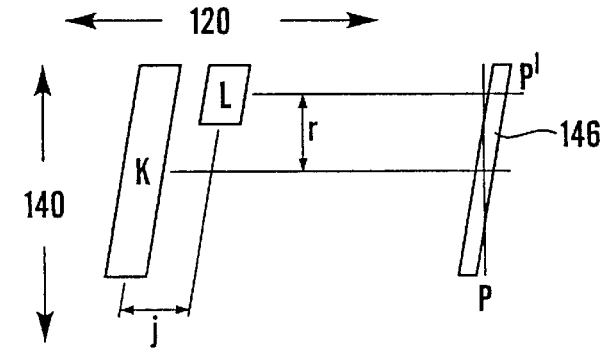
Fig.6a
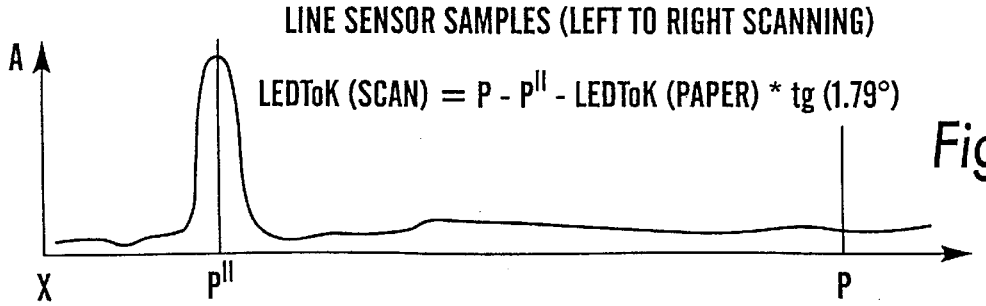
Fig.6b

APPARATUS AND METHOD FOR ACCURATELY POSITIONING INKJET PRINTHEADS

BACKGROUND OF INVENTION

1. Field of the Invention

The present invention relates to determining the relative location of components of a printing apparatus, for example a large format printer. In particular, in inkjet printers having a printhead service station, there is a need to accurately position the inkjet printheads relative to their respective service station cartridges.

2. Description of the Related Art

The service station is an essential subsystem in printers based on thermal inkjet technology (TIT). Its main purpose is to maintain optimal print quality and to do so, it can act on the printhead or pen in different ways (such as wiping, spitting . . . ). These actions are termed "servicing primitives". They are arranged in complex sequences (servicing algorithms), that are executed in response to various triggers.

The functions a service station provides depend on the architecture, but as the printhead complexity increases, more and more sophisticated features need to be implemented. For instance, in the present printing apparatus there may be up to eight different "primitives", namely: capping, spitting, wiping, PEG (i.e. the application of polyethylene glycol liquid), scraping, snout wiping, priming and drop detection. Since the volume occupied by the service station is much the same as in previous products and because more functionality has been added, there is less space available for each "primitive".

The servicing functions can work correctly with a maximum placement error of 0.8 millimeters for the scan axis. The service station axis substantially perpendicular to the scan axis is somewhat more tolerant accepting up to 1.5 millimeters. Unfortunately, the mechanical tolerances alone, while meeting the goal in the service station axis, are unacceptable for the scan axis (the worst-case placement error is 1.4 millimeters).

Therefore, a method of reducing tolerance problems along the scan axis is required. One possible way would involve an expensive production process with better tolerances. An alternative is to calibrate the error out of the system. This determines the physical position of the components and adjusts each function based on this measurement.

The printers in the series HP Designjet 2000 and 2500, first marketed in March 1997, adopted the solution of placing an optical reference mark on the service station housing which is scanned by an optical sensor mounted on the printer carriage. This did not allow for any tolerances between the housing and the position of the service station cartridges within the housing. Moreover, no measures were taken to allow for possible variations in the relative positions on the printer carriage of the optical sensor and the printhead cartridges. Such prior art printers are disclosed in U.S. patent application Ser. No. 09/031,115.

EP-A-0863009 discloses an optical encoding arrangement incorporating a marker for orientation on a service station carriage and a label for carrying information related to service station functions. The service station module may incorporate holes for storing and conveying information.

The present invention seeks to overcome or reduce one or more of the above problems.

BRIEF SUMMARY OF THE INVENTION

According to a first aspect of the present invention, there is provided a method of determining the relative location of a component of a printer apparatus with respect to a printhead carriage of the printer apparatus, said component comprising one or more sub-units co-operating with a corresponding number of printheads on the carriage, wherein a sensor is used to determine the position of a reference location on said component relative to the sensor, characterised in that the sensor is also used to determine the position of at least one printhead relative to the sensor.

According to a second aspect of the present invention, there is provided a method of relatively locating at least one component of a printer apparatus to a printhead mounted on a printer carriage, wherein a sensor mounted on the carriage is used to scan a reference location on the component, characterised in that there is also determined the relative location of the optical sensor to the printhead on the printer carriage.

The sensor is preferably an optical sensor and, to determine the relative location of the optical sensor to the printhead (K), the printhead is caused to print during a carriage movement a reference mark extending substantially in the direction of the media axis, and the optical sensor subsequently scans the reference mark along the scan axis and there is determined therefrom the sensor to printhead distance ("j") in the direction of the scan axis. The reference mark is preferably a straight line.

In a preferred method the step of determining the sensor to printhead distance (j) is preceded by causing the printhead (K) to print a reference mark in the direction of the scan axis, then using the optical sensor to scan the reference mark along the media axis of the printing apparatus, and then determining the sensor to printhead distance (r) in the direction of the media axis and taking into account its effect on the determination of the sensor to printhead distance (j) in the direction of the scan axis. The reference mark extending in the direction of the scan axis is also preferably a straight line.

According to a third aspect of the present invention, there is provided a method of determining the relative location of at least one printhead mounted on a printer carriage with respect to one or more service station insert members mounted in a service station, the method using an optical sensor mounted on the printer carriage. characterised in that the sensor detects a reference location provided on at least one of said service station insert members. The insert members are preferably cartridges which perform various servicing functions and may each be associated with a respective printhead.

According to a fourth aspect of the present invention, there is provided an inkjet printing apparatus comprising one or more printheads mounted on a printer carriage and means for determining the position of at least one other component of the printing apparatus relative to the or each printhead, said determining means comprising a sensor mounted on the printer carriage, characterised in that calibration means are provided which determine the relative positions of the sensor and the or each printhead. The sensor is preferably an optical sensor.

According to a fifth aspect of the present invention, there is provided an inkjet printing apparatus having means for locating one or more printheads mounted on a printer carriage with respect to one or more respective service station insert members mounted in a service station, the apparatus comprising an optical sensor mounted on the printer carriage and means defining one or more reference locations within the service station area, the reference locations being optically detectable by the optical sensor, characterised in that the or each reference location is provided on a respective service station insert member.

Preferably each reference location is constituted by a through a hole in a part of the respective service station insert member, e.g. in its handle or lid.

Preferably, each service station insert member has a respective reference location. These locations may be averaged to reduce any residual errors.

BRIEF DESCRIPTION OF THE DRAWINGS

A preferred embodiment of the present invention will now be described, by way of example only, with reference to the accompanying drawings, of which:

FIGS. 5*a* and 5*b* are diagrams illustrating the distance calibration along the media advance axis;

FIGS. 6*a* and 6*b* are diagrams illustrating the distance calibration along the scan axis;

DETAILED DESCRIPTION OF THE INVENTION

Figure 1:
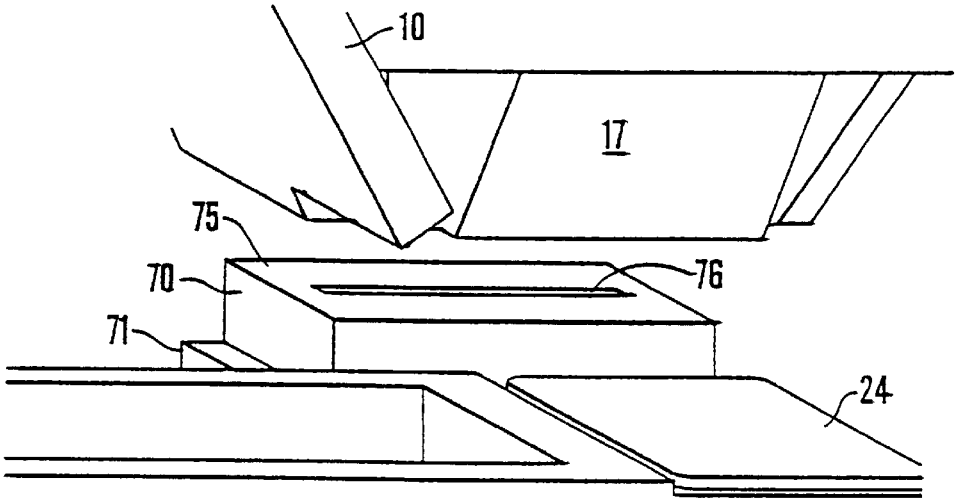
Fig. 1 (PRIOR ART)
FIG. 1 is a partial perspective view of part of the optical sensor and a reference mark of a prior art printer.

Referring to the drawings. FIG. 1 shows a prior art arrangement illustrating the type of location system used in Hewlett-Packard Designjet printers in the 2000 and 2500 series. FIG. 1 corresponds to FIG. 13 of the previously-mentioned pending U.S. patent application Ser. No. 09/031,115. An optical sensor 17 including a light emitting diode and a photocell (not shown) is mounted on a printer carriage 10. A service station housing 24 is of black plastics material and has a mount section 71 for an insert section 70 which is of white material for the purposes of contrast. Section 70 has a white top surface 75 which defines a rectangular slot 76 to constitute a reference mark which is traversed by the sensor 17 to locate its position relative to the printer carriage 10.

Figure 2:
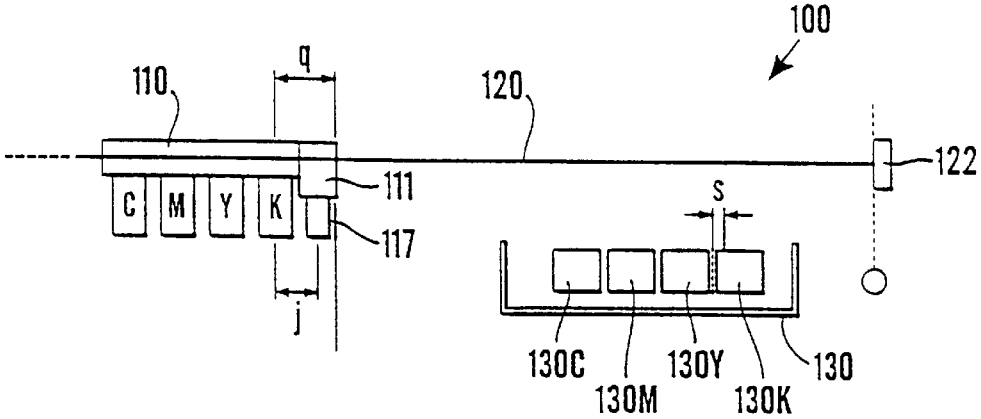
FIG. 2 is a schematic front sectional view of the parts of a printing apparatus used for determining the relative location, the view being taken in a plane which bisects the printer components in the direction of the paper axis.
Figure 3:
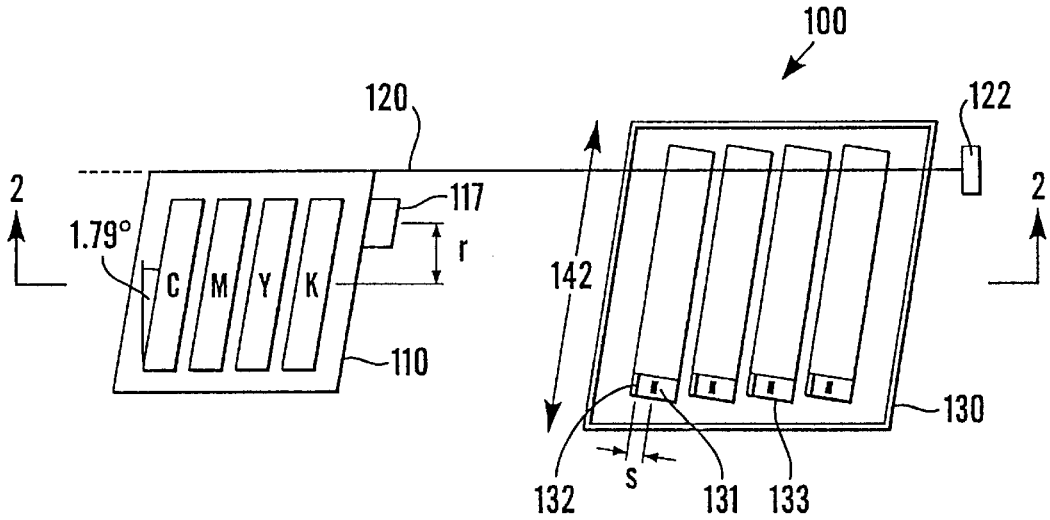
FIG. 3 is a top plan view of the printing apparatus of FIG. 2.

FIGS. 2 and 3 show front and top plan views of a printing apparatus 100 in accordance with the present invention. Mounted on printer carriage 110 are a black printhead or pen K, three colour printheads C, M and Y, e.g. cyan, magenta and yellow, and a line sensor 117 incorporating a light-emitting diode and a photocell. The end 111 of carriage defines its position along the scan axis 120, which has a point of origin at a right bump position 122. Also illustrated in FIG. 2 are a "LED to K" distance "j" and a "carriage edge to K" distance "q" along the scan axis.

A service station 130 is located adjacent to one end of the carriage scan axis and comprises four respective service station insert members. The insert members are manufactured independently and subsequently inserted in the service station housing. The insert members are preferably service station cartridges incorporating four printhead cleaners 130C, 130M, 130Y, 130K, corresponding to the four colour printheads. As shown in FIG. 3, each cleaner lid has a handle or grip portion 131 which includes a through hole or slot 132 adjacent to and at a predetermined distance from one end of portion 131. At a central position of each portion 131 there is attached a label 133 which is originally blank but is subsequently inked to represent use of the printing apparatus. The label may incorporate information in written and/or coded form indicating the appropriate type of ink.

Because the nozzles of each printhead are spaced transversely to the scan axis, and because the printer carriage 110 moves continuously during printing, it is known to angle the printheads C, M, Y, K by a small angle of 1.79° relative to the true perpendicular direction, and this is shown in exaggerated fashion in the top plan view of FIG. 3. Of course, the printhead cleaners are also slanted at the same angle so that the paper movement axis 140 is at 1.79° to the so-called service station axis 142.

FIG. 3 also indicates a "LED to K" distance "r" (distance between centers) along the paper axis. Both FIGS. 2 and 3 also indicate a reference hole 132 to printhead cleaner center distance "s".

Figure 4:
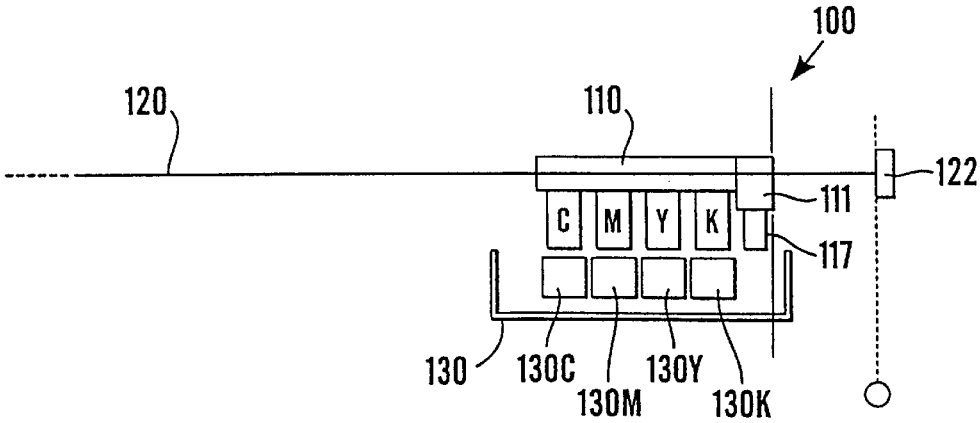
FIG. 4 is a front view of the printing apparatus with its printheads capped.

FIG. 4 is a view corresponding to FIG. 2 but with the printheads C, M, Y and K in their capped disposition, with carriage edge 111 in its "capping position". As will now be described, the purpose of the calibration process is to ensure that each printhead is aligned as accurately as possible with the center of its corresponding cleaner.

The calibration process comprises the following steps:

a) LED Calibration

To have an optimal signal-to-noise ratio when using the line sensor 117, the printer needs to ascertain the optimum gain and LED type for the particular printing medium type which is loaded. This is accomplished by LED calibration by printing a black box 150, FIG. 8 on an inserted paper sheet 155, and then scanning over the black box and the adjacent white area. In practice, box 150 is printed solidly in black ink. The line sensor control block then modifies its internal parameters to work optimally in this range.

b) Drop detector calibration for the K printhead

The following step c) of the process involves the printing of a line in the direction of the scan axis. Since such a pattern is very sensitive to "nozzles out" (a nozzle out at the boundary produces an error of one dot), step b) involves facilitating the avoidance of such an error. To achieve independence from the K printhead status, the drop detector is calibrated and a drop detection process is then performed to look for a group of 32 consecutive working nozzles. This information is used subsequently when drawing the line in the direction of the scan axis.

c) Line sensor to K pen distance "s" calibration for the media axis

Figure 8:
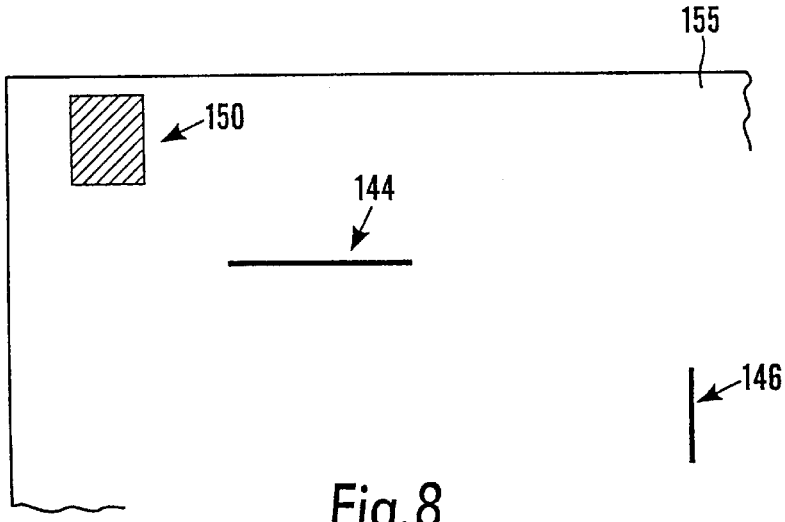
FIG. 8 shows the printouts produced on the print medium during calibration.

A reference mark in the form of a black line pattern 144, FIGS. 5*a* and 8, of 32-nozzle height "w", is drawn in the direction of the scan axis, in this case horizontally. Healthy nozzles are used, as a result of step b). Sensor 117 then scans (with bottom-up scanning) along the paper axis 140, to produce the sample shown in FIG. 5*b*, and the distance "r" from the line sensor to the K printhead is then determined, taking into account which 32 nozzles were used. Knowing the distance "h" of the first nozzle reached from the center of the printhead, one obtains the result:

$$r=p-p'-h-w/2$$

where p represents the position of the center of the printed line and p' represents the position as read by the sensor.

d) Line sensor to K pen distance "j" calibration for the scan axis

A reference mark in the form of a black line 146, FIGS. 6*a* and 8, is drawn, by firing the K printhead during a carriage movement. The line 146 extends substantially in the direction of the media axis, in this case substantially vertically. As explained above, this pattern will actually have a slant of 1.79°. Sensor 117 then scans (with left to right scanning) along the scan axis 120, to produce the sample shown in FIG. 6*b*, and the distance "j" from the line sensor to the K printhead is then determined. Knowing the distance "r" relating to the paper axis, one obtains the result:

$$j=p-p''-r \tan 1.79°$$

where p represents the position of the center of the printed line and p" represents the position as read by the sensor.

In practice, lines 144 and 146 are printed solidly in black ink.

e) Detection of printhead cleaners to determine the capping position

Figure 7A:
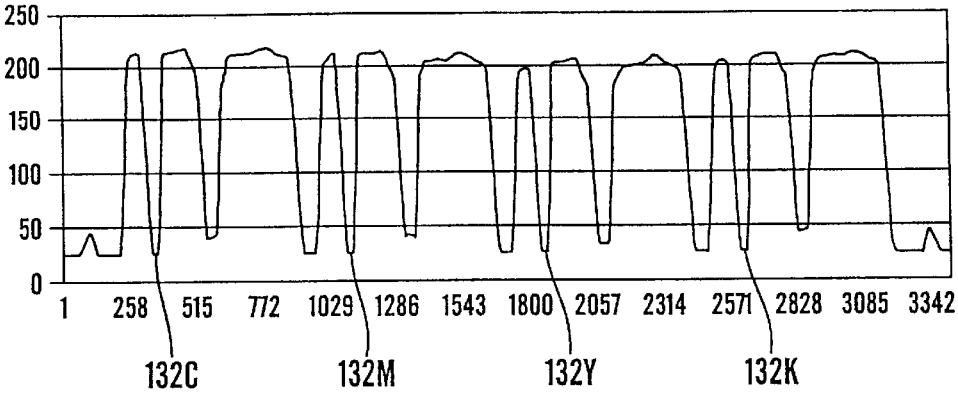
FIGS. 7*a* and 7*b* are optical sensor waveforms obtained with clean and dirty service station cartridges respectively.

The line sensor 117 is then scanned over the portions 131 of the printhead cleaners, typically obtaining a waveform as shown in FIG. 7*a* for new printhead cleaners. The small "bumps" at the extreme left and right of the waveform represent the edges of the service station housing. The waveform in between represents features of the service station cartridges, and in particular, from the left, the vertical lines represent respectively:

left end of cartridge portion 131 left side of hole 132 right side of hole 132 left side of label 133 right side of label 133 right end of cartridge portion 131 left end of portion 131 of next cartridge etc.

The scanning process includes the following steps:

(i) Signal treatment

This involves signal normalization, non-linear morphological filter and derivative calculation. This normalizes the signal and eliminates noise peaks and valleys which could adversely affect the following steps.

(ii) Cross-shape recognition

This enables determination of the approximate position of each printhead cleaner cartridge. The samples are then divided and analyzed separately.

(iii) Feature extraction

Figure 7B:
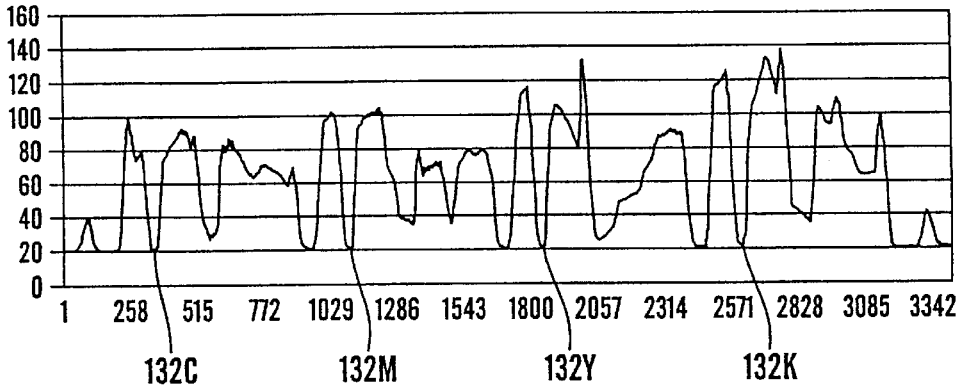

For each printhead cleaner the various edges, holes and marks are identified. The position of hole 132 is selected as the most accurate indicator. The positions of the holes for the four service station cartridges are indicated at 132C, 132M, 132Y and 132K in FIG. 7. FIG. 7*b* indicates a waveform corresponding to FIG. 7*a* but of a dirty printhead cleaner, e.g. after a prolonged period of use. Despite general deterioration of the waveform because of ink covering portions 131, the locations of the through holes 132 are still distinct because they provide a sharper contrast.

(iv) Determination of center of service station cartridges

This is simply achieved by adding the distance "s" to the hole positions.

(v) Determination of "K printhead to K service station cartridge" distance

Once the location of the center of the cartridge 130K relative to the line sensor is known from step (iv), the position relative to the K printhead can be calculated simply by adding the LED to K printhead distance "j". In practice, the center positions of the other three cartridges 130C, 130M and 130Y are also taken into account by means of a suitable averaging process. In this way, the effect of any misalignment of these other cartridges is minimized, and a satisfactory capping of all printheads can occur. Accuracy of positioning with less than ±0.7 mm of error is obtained.

The above-described calibration process typically occurs only once during the lifetime of a printer. If the printheads or the service station cartridges are replaced, they usually remain within satisfactory tolerances. However, should there be a loss of memory, or should the entire service station housing need replacing, for example, then the control system is configured so that a service engineer may use the process to re-calibrate the positions of the printer components.

The above-described arrangement has the advantage of reducing tolerance problems in two ways, namely calibrating the position of the service station cartridges 130 themselves, rather than the housing, and also taking into account the actual "LED to K" distance "j". Using holes 132 in the cartridges provides accurate location thereof, and taking into account the location of all four cartridges 130, and then averaging their displacements from a nominal position, reduces any residual errors in positioning for the capping process. The capping function of the service station is the one requiring the tightest tolerance and so the capping region is the best region to locate the calibration holes 132. The thus-determined capping position serves as a reference for the rest of the servicing "primitives".

Various modifications may be made to the above-described arrangement. For example, in addition to averaging over the four printhead cleaner cartridges, one could also average over the four printhead positions to obtain a modified value for "j". Also, or in addition, to shorten and simplify the process, only the distance to the hole 132K of the black printhead cleaner 130K may be determined.

The calibrated part of the service station cartridge may be other than the capping position.

If desired, a hole or other reference marking on the service station housing could be used, as in the prior art. This still gives an improved positioning accuracy, since the distance "j" is more accurately determined than allowed previously by the tolerance of the mechanical housing. Indeed, the reference location may be on a component of the printer other than the service station. For example, the precise determination of "j" can be used in the printhead alignment process to accurately place the line sensor 117 over narrow patterns. It can also be used to allow the calculation of the real position of the media margins, which is crucial for the media loader.

Alternatively, the value of "j" may be taken as a preset value, in which case the improved calibration results from the determination of the actual positions of one or more of the printhead cleaner cartridges.

In other printers it may be arranged that the scan axis and media axis have other orientations, e.g. vertical and horizontal respectively.

What is claimed is:

1. A method of determining a relative location of a component of a printer apparatus with respect to a printhead carriage of said printer apparatus, said method comprising the step of providing said component with one or more sub-units co-operating with a corresponding number of printheads on said printhead carriage, wherein a sensor is used to determine a position of at least one reference location on said component relative to said sensor, and wherein said sensor is also used to determine the position of at least one printhead relative to said sensor.

2. A method according to claim 1, wherein there is first determined a sensor to printhead distance (j) in a direction of a scan axis or a sensor to printhead distance (r) in a direction of a media axis and then there is determined the other (r,j) of said distances.

3. A method according to claim 2, wherein said sensor is an optical sensor and, to determine said relative location of said optical sensor to said printhead, said printhead is caused to print during a carriage movement a reference mark extending substantially in said direction of said media axis, and said optical sensor subsequently scans said reference mark along said scan axis and there is determined therefrom said sensor to printhead distance ("j") in said direction of said scan axis.

4. A method according to claim 3, wherein the step of determining said sensor to printhead distance (j) is preceded by causing said printhead to print a reference mark in said direction of said scan axis, then using said optical sensor to scan said reference mark along said media axis, and then determining said sensor to printhead distance (r) in said direction of said media axis and taking into account the effect of distance (r) on the determination of said sensor to printhead distance (j) in said direction of said scan axis.

5. A method according to claim 4, wherein said reference mark in said direction of said scan axis is printed by a selected group of adjacent nozzles of a particular printhead and wherein, before printing said reference mark, a check is made for an appropriately-sized group of working nozzles, a distance (h) of said group from the center of said particular printhead being taken into account when calculating said sensor to printhead distance (r) in said direction of said media axis.

6. A method according to claim 1, wherein said reference location is constituted by a through hole.

7. A method according to claim 1, wherein the sensor scans a plurality of reference locations respectively on mutually-associated sub-units of said component, resulting in a plurality of measurements that are subjected to an averaging process.

8. A method according to claim 7, wherein the mutually-associated sub-units are one or more printhead cleaners of a printer service station.

9. A method according to claim 1, wherein there is performed a relative location determining step to co-ordinate a co-operation of sub-units of a first component with respective sub-units of a second component.

10. A method of determining a relative location of at least one component of a printer apparatus to a printhead mounted on a printer carriage, wherein said method comprises the step of providing a sensor mounted on said carriage, said sensor being used to scan at least one reference location on said component and wherein there is also determined a relative location of said sensor to the printhead on said printer carriage.

11. A method of determining a relative location of at least one printhead mounted on a printer carriage with respect to one or more service station insert members mounted in a service station, said method comprising the step of using an optical sensor mounted on said printer carnage, wherein said sensor detects a reference location provided on at least one of said service station insert members, and wherein said sensor is also used to determine the position of at least one printhead relative to said sensor.

12. A method according to claim 11, wherein said sensor detects reference locations arranged on respective ones of said service station insert members, resulting in measurements that are averaged.

13. An inkjet printing apparatus comprising one or more printheads mounted on a printer carriage and means for determining a position of at least one other component of said printing apparatus relative to said one or more printheads, said determining means comprising a sensor mounted on said printer carriage, characterised in that calibration means are provided which determine the relative positions of said sensor and said one or more printheads.

14. An inkjet printing apparatus according to claim 13, wherein said sensor is an optical sensor and said other component is a printhead cleaner insert member of a printer service station and having a through hole in a portion thereof which is detected by said optical sensor.

15. An inkjet printing apparatus comprising an optical sensor and one or more printheads mounted on a printer carriage and one or more respective service station insert members mounted in a service station, and one or more reference locations within an area of said service station, said reference locations being optically detectable by said optical sensor, wherein each of said one or more reference locations are provided on a respective service station insert member.

16. A printing apparatus according to claim 15, wherein each of said one or more reference locations are constituted by a through hole in a portion of said respective service station insert member.

17. A printing apparatus according to claim 15, wherein each service station insert member has a respective reference location and means are provided for averaging a plurality of measurements for a plurality of reference locations and taking the averaged result into account when determining a printhead to service station insert member distance.

* * * * *